US005343793A

United States Patent [19]

Pattie

[11] Patent Number: 5,343,793

[45] Date of Patent: Sep. 6, 1994

[54] AUTOMATICALLY TUNED MUSICAL INSTRUMENT

[76] Inventor: Michael Pattie, 12706 La Salle Dr., Austin, Tex. 78727

[21] Appl. No.: 957,276

[22] Filed: Oct. 6, 1992

[51] Int. Cl.[5] ..... A10G 7/02

[52] U.S. Cl. ..... 84/454; 84/329; 84/297 R; 84/303; 84/DIG. 18

[58] Field of Search ..... 84/455, 454, D18, 303, 84/297 R, 329, 458, 726

[56] References Cited

U.S. PATENT DOCUMENTS

| | | | |
|---|---|---|---|
| 2,812,682 | 11/1957 | Longone et al. | 84/458 |
| 4,088,052 | 5/1978 | Hedrick | 84/454 |
| 4,196,652 | 4/1980 | Raskin | 84/454 |
| 4,338,846 | 7/1982 | Pogoda | 84/454 |
| 4,426,907 | 1/1984 | Scholz | 84/454 |
| 4,584,923 | 4/1986 | Minnick | 84/454 |
| 4,750,397 | 6/1988 | Ashworth-Jones | 84/267 |
| 4,803,908 | 2/1989 | Skinn et al. | 84/454 |
| 4,909,126 | 3/1990 | Skinn et al. | 84/454 |
| 4,928,563 | 5/1990 | Murata et al. | 84/454 |
| 4,991,484 | 2/1991 | Kawashima | 84/454 |
| 5,009,142 | 4/1991 | Kurtz | 84/454 |
| 5,018,428 | 5/1991 | Uchiyama et al. | 84/456 |
| 5,038,657 | 8/1991 | Busley | 84/454 |
| 5,065,660 | 11/1991 | de Buda | 84/454 |
| 5,070,754 | 12/1991 | Adamson | 84/454 |
| 5,142,961 | 9/1992 | Paroutaud | 84/726 |

*Primary Examiner*—Michael A. Gellner
*Assistant Examiner*—Cassandra Spyrou
*Attorney, Agent, or Firm*—Gunn & Kuffner

[57] ABSTRACT

An automatically tuned musical instrument provides a means for keeping strings under tension in proper tune. It also provides a mechanism to simplify installing new strings on the instrument. The tuning system includes a magnitude comparator to eliminate crosstalk which can result in improperly tuning one string when receiving a tone from an adjacent string. The system tensions a string or a plurality of strings at fast speed to within a whole tone or their desired frequency and then fine tunes the strings to desired frequencies. The mechanism includes a guide canal for each string to guide the string into pinch rollers and a flexible conduit to guide the string onto a guide reel to provide an easy, sure way to install strings onto the instrument.

17 Claims, 10 Drawing Sheets

AUTOMATICALLY TUNED MUSICAL INSTRUMENT

BACKGROUND OF THE INVENTION

The present invention relates generally to the field of automatically tuned stringed instruments and, more particularly, to an automatically tuned guitar.

A number of tuning systems to automatically tune a musical instrument have been proposed. Skinn et al., in U.S. Pat. Nos. 4,803,908 and 4,909,126, teaches a tuning system that is broadly applicable to stringed and brass instruments. The system detects musical tones and produces a blended signal which is converted to a digital signal. The digital signal is converted to a frequency signal which is compared to a predetermined frequency value to produce an electrical signal which actuates a motor to perform the tuning function. However, the system of Skinn et al. makes no allowance for distinguishing the vibration of one string from that of an adjacent string. This presents the potential for pitch confusion where a plurality of adjacent string work in coordination with a pitch detection device. This may be referred to as "inter-pickup crosstalk."

For example, imagine tuning a guitar's fifth string from a completely loose condition to it standard pitch of 440 Hz. To get to that frequency, the frequency of the string must first pass through 330 Hz, the standard frequency of the sixth string. If the pickup for the sixth string detects this frequency, it will falsely actuate the tuning channel for the sixth string.

Thus, there remains a need for an automatic tuning system for a stringed musical instrument in which there is a dedicated pickup for each string of the instrument. The system must also be able to accurately distinguish precisely which string is being strummed or which string of a plurality of strings is to be tuned by the system. Such a system should eliminate inter-pickup crosstalk.

Another problem in the prior art lies in its inability to distinguish enharmonic fretted tones. In other words, a guitar is normally manually tuned by depressing a string a number frets up from the bridge and comparing its tone with that of the next higher string on the instrument. The tautness of the string is adjusted and its adjusted tone is again compared to that of the adjacent string. This is repeated until the strings have the same tone and the process is repeated until all of the strings are in tune.

In the prior art, no provision is made to prevent pickups other than the one for a specific string from picking up the tone from an adjacent string and begin adjusting the tension on the wrong string. As used herein, the term "fretted string" refers to a string that is depressed against a fret. Prior art systems failed to recognize the problem of distinguishing tones from adjacent fretted strings. Thus, there remains a need for an automatic tuning system that will only tune a string in response to a tone detected from that string. Such a system should also eliminate the effect of one string's vibration on the field of all adjacent pickups.

The prior art's claims of automatic tuning are automatic in the sense that, once one has wound the string manually to a frequency close to that desired, the string tensioning apparatus in coordination with a pitch detector will maintain a certain tufting. The prior art docs not coordinate the degrees of pitch increase with the fixed step nature of the motor. Kurtz, U.S. Pat. No. 5,009,142, recognized the problem associated with string strain effect on tension and pitch increase but offers a solution that involves manual winding. Skinn incorporated a linear actuated motor as a means for string winding but this method is also manual to a point. This method does not take into account that, on one string, string tension yields different rates of pitch increase. Thus, the fixed degrees of a stepper motor may not be in sync with the desired frequency. The fixed gear steps driven by a stepper motor must synchronize with a predetermined set of pitch steps. If the steps of the stepper motor are not coordinated with desired steps of pitch, reaching a desired pitch is a matter of pure luck. In order to know what a gear step will produce in terms of pitch increase or decrease, the system must factor in the pulse train signal to the stepper motor, reduction gear output, dimensions of the tuning apparatus, string tension, and specific frequency ranges in which the system is activated and deactivated.

An automatic tuning system for a stringed musical instrument should also provide a "dead zone" at predetermined gear steps before and after a desired pitch for each string. A dead zone permits the string to go slightly out of tune before being automatically retuned. This feature keeps the strings most nearly in tune and prevents "hunting" in which the system constantly tunes to find the exact desired frequency.

Such a system should also provide an easy means to install new strings and remove old or broken strings. The system should provide a simple to use guide which directs the strings into the tuning apparatus without difficulty.

SUMMARY OF THE INVENTION

The present invention provides an accurate automatic tuning system for tuning stringed, fretted instruments. It provides a magnitude comparator that compares signals from the string of interest to signals received from adjacent strings to filter out undesired tones as noise. It also provides a fret assembly switch matrix to eliminate interference from fretted strings. The pickups dedicated to the automatic tuning system are baffled to reduce interference from adjacent strings. The system also provides a simple, easy to use apparatus that guides the strings into the tuning apparatus.

These and other objects and features of the present invention will be readily apparent to those of skill in the art when reviewing the following detailed description.

BRIEF DESCRIPTION OF THE DRAWING FIGURES

FIG. 2 depicts a pure tone sensed by a pickup incorporated in the present invention while

Figure 18C:
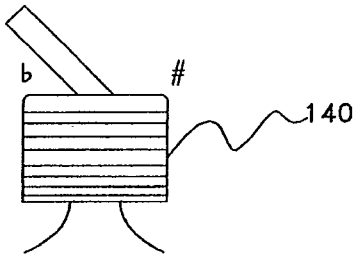
Figure 18B:
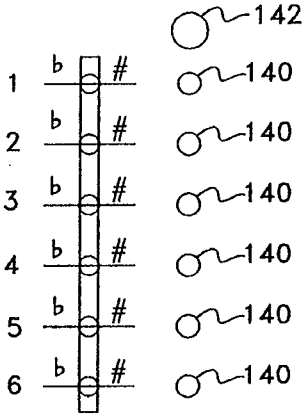
Figure 18A:
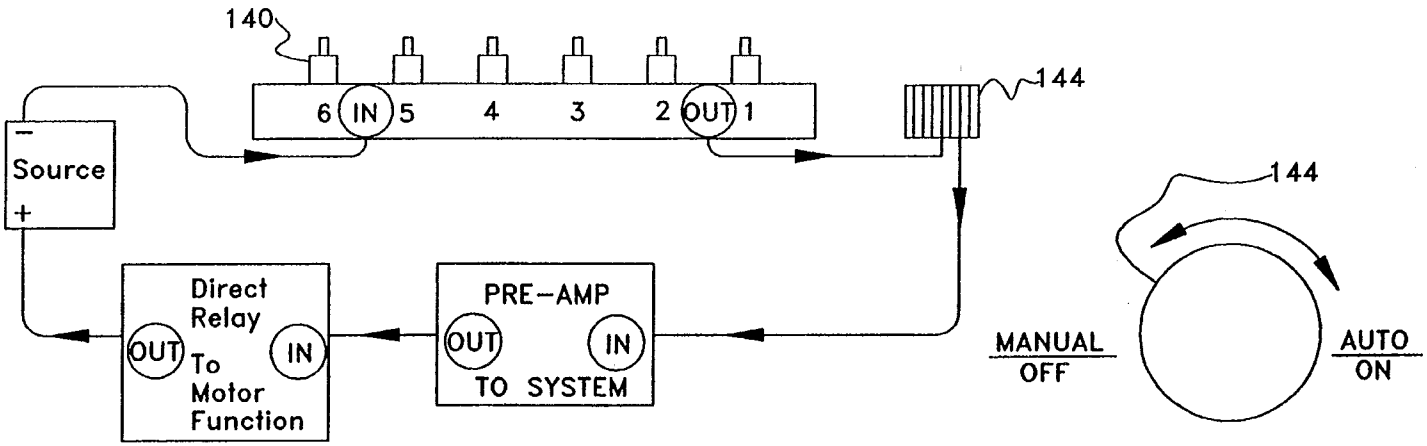

FIG. 18A, B, and C depict an enabling/disabling feature of the present invention.

Figure 19:
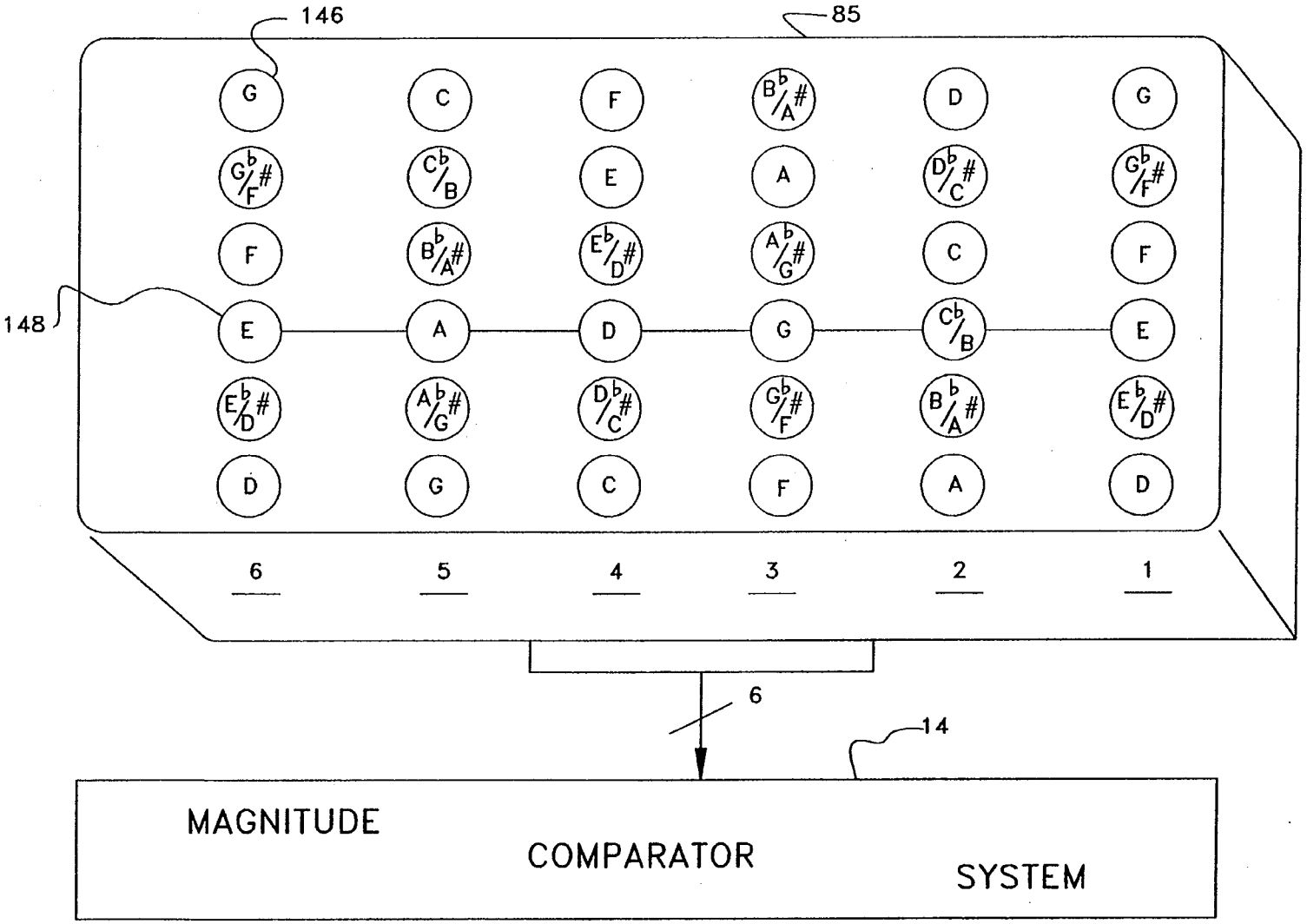

FIG. 19 depicts an alternate tuning feature of the present invention.

DETAILED DESCRIPTION OF A PREFERRED EMBODIMENT

The following detailed description first describes the electronics involved in the present invention and then describes the mechanical aspects of an automatically tuned stringed instrument.

Figure 1:
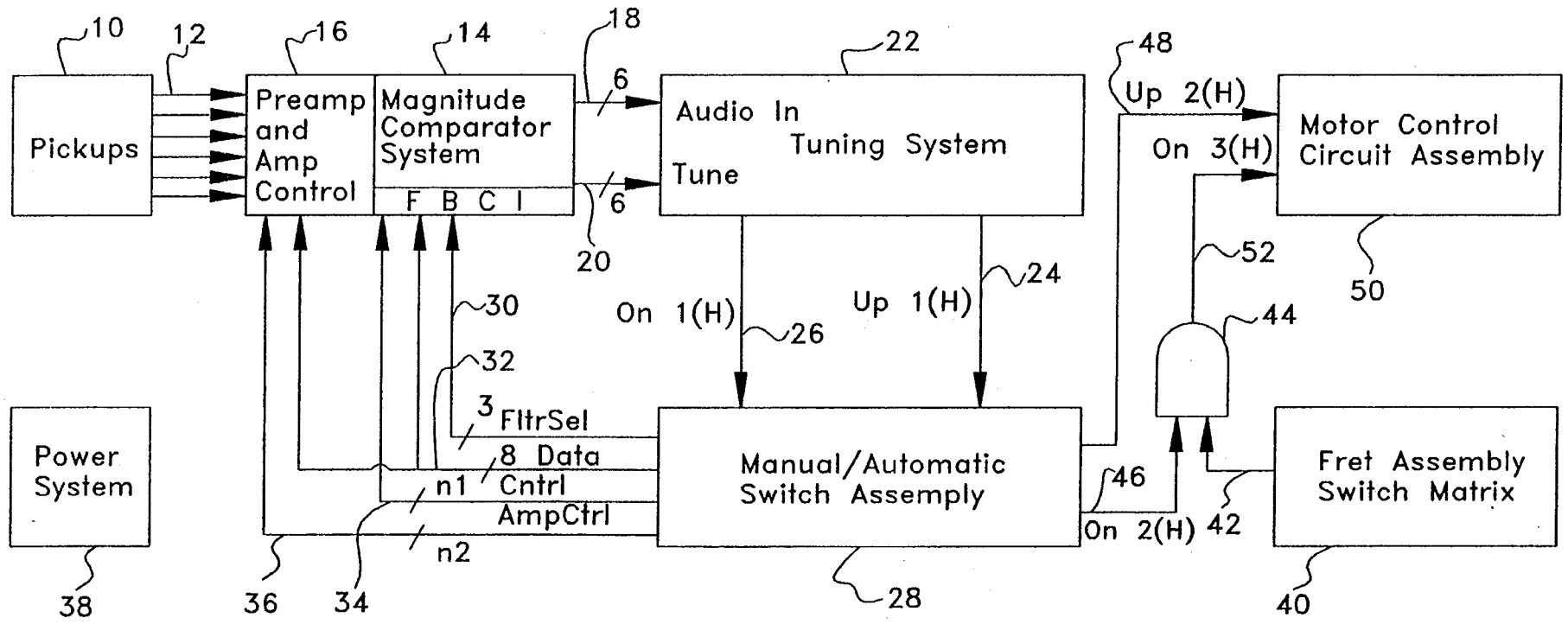
FIG. 1 depicts an overall block diagram of the electronic portion of an automatic tuning system of the present invention.

FIG. 1 depicts an overall functional block diagram of a preferred embodiment of the present invention. The system includes a plurality of pickups 10, one for each string of a stringed musical instrument. As used herein, the term "pickup" refers to any means of detecting the vibration of a string of a musical instrument. In a preferred embodiment, the pickups are shielded magnetic pickups. The pickups 10 are separate from the pickup normally associated with, for example, an electric guitar, to reproduce the sound of the strings over an amplification system. The pickups 10 sense the vibration of the strings of the instrument and develop an audio signal 12 that is used by the tuning system to tune one of the strings of the instrument.

The pickups must be as directional as possible (thereby reducing any "fringe" effects, i.e., a reduction in adjacent string signal pickup), yet provide as high an output level as possible. That is, each pickup should provide a strong audio signal for the string to which it is directed while minimizing signals from adjacent strings.

The audio signals 12 feed a magnitude comparator system 14 (MCS) through a preamp and amplifier control 16. The preamp and amplifier control 16 amplifies and shapes the audio signals 12 into a useful electronic signal for use by the magnitude comparator system 14. The magnitude comparator system 14 provides a means for the tuning system to distinguish which strings are being "plucked" or "strummed" (creating vibration of the strings). The MCS 14 also associates pitches detected by the tuning system with those plucked strings. In this way, the tuning system distinguishes alternately-tuned strings being sounded, picked up by adjacent string pickups 10, and having the tuning system try to tune an adjacent string rather than the one that actually sounded. The MCS 14 is described in greater detail in regard to FIG. 4.

The MCS 14 develops an audio signal 18 and a tune control signal 20, each of which comprises six signal lines, as shown in FIG. 1. The audio signal 18 is fed into an "audio in" input of a tuning system 22. Similarly, the tune control signal 20 is fed into a "tune" input of the tuning system 22. The tuning system 22 provides the tuning function of the present invention and may be embodied by a number of presently available electronic means. Its primary function is to provide a method of evaluating an incoming frequency that emanate the a given string, compare that frequency to a desired tuning for that string, and, if tuning is required, send the relevant control signals to the mechanical tuning assembly that tightens or loosens a string to the desired tautness at the proper frequency.

The tuning system 20, upon analyzing the audio signal 18 and the tune control signal 20 develops either an "up" control signal 24 or a "down" control signal 26. These signals feed a manual/automatic switch assembly 28. The switch assembly 28 provides the human operator with a method of controlling both the automatic tuning system as well as the override of the automatic system to permit manual adjustment of the instrument's tuning.

The manual/automatic switch assembly 28 communicates with the MCS over a number of control lines. The bit values shown in FIG. 1 are exemplary only and are not intended as a limitation of the present invention. A 3-bit filter select control line 30 determines which of a bank of filters is activated in selecting a particular band of frequencies, as determined by which string of the instrument is to be tuned. The switch assembly 28 communicates hi-directionally with the MCS 14 via a data line 32 and provides amplifier control via a set of control line 34 and 36. The system also includes a power supply system 38 to energize circuit components in the conventional manner.

Figure 9:
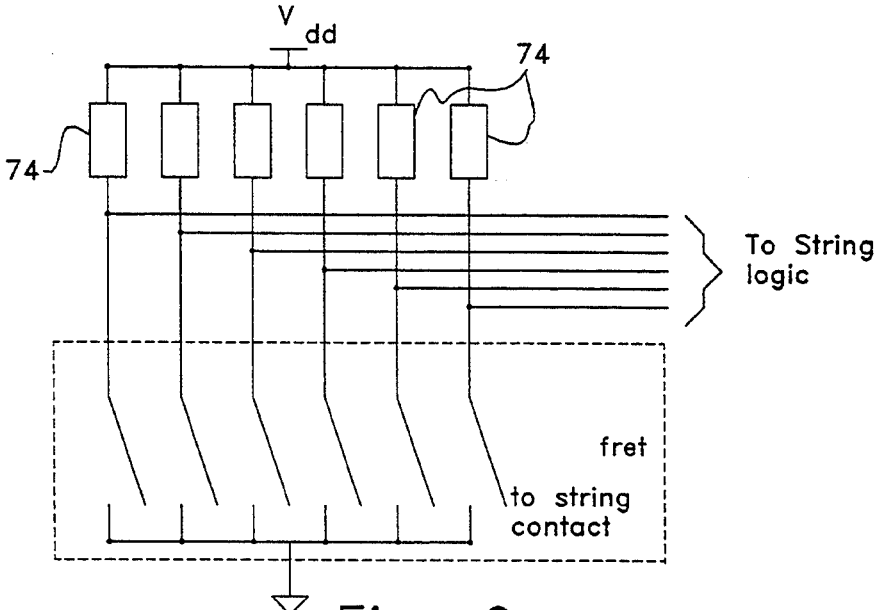
FIG. 9 is a block diagram of a fret/string switch matrix.

The present invention is arranged to only tune strings that are not depressed or "fretted" by the operator. In this way, each string will have only one predetermined conventional tuning frequency. Alternate tuning is also provided but, again, only strings that are not fretted can be tuned. A fret assembly switch matrix 40 prevents fretted strings from falsely actuating the tuning system. In its simplest form, as shown in FIG. 9, the fret assembly switch matrix simply as a set of contacts to disable the automatic tuning system. The fret assembly switch matrix may also use fret contact to develop logic signals for more complex system control.

Since it is quite possible to fret a lower string and make it sound with the same pitch as a higher string, there is potential confusion to any type of automatic tuning system. By incorporating this fret assembly switch matrix, only those strings which are strummed while open (i.e., not fretted) will be candidates for tuning by the rest of the automatic tuning system. The fret assembly switch matrix 40 thus develops an enable signal 42 which provides one input to an AND gate 44. The other input to the AND gate 44 is provided by the manual/automatic switch assembly 28 via an "on" signal 46. The switch assembly 28 also develops an "up" control signal 48 which feeds a motor control circuit assembly 50. The motor control circuit assembly 50 also receives an input from the AND gate 44 via an "on" control signal 52. The motor control circuit assembly 50 provides the electronically appropriate interface from the tuning system to control the selected motors which mechanically engage the strings of the musical instrument to provide tuning.

Figure 2:
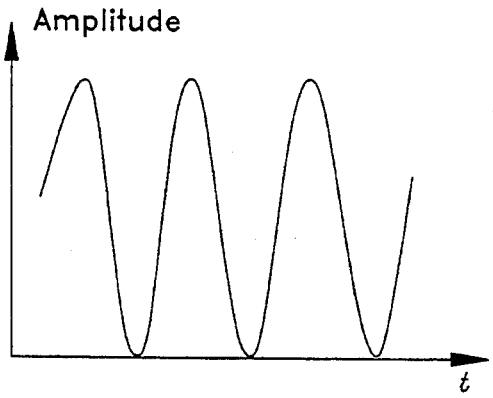
Figure 3:
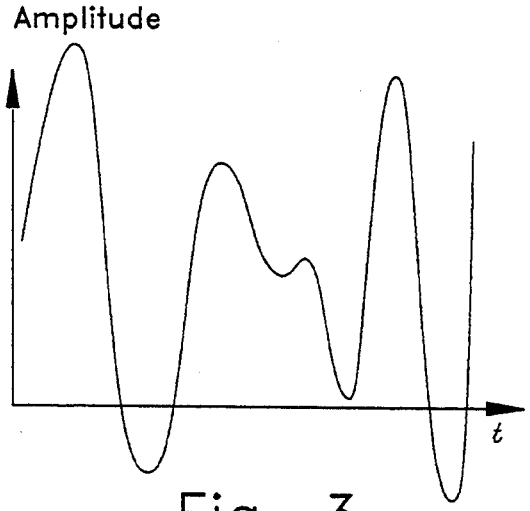
FIG. 3 depicts a pure tone with a tone from an adjacent string superimposed.
Figure 4:
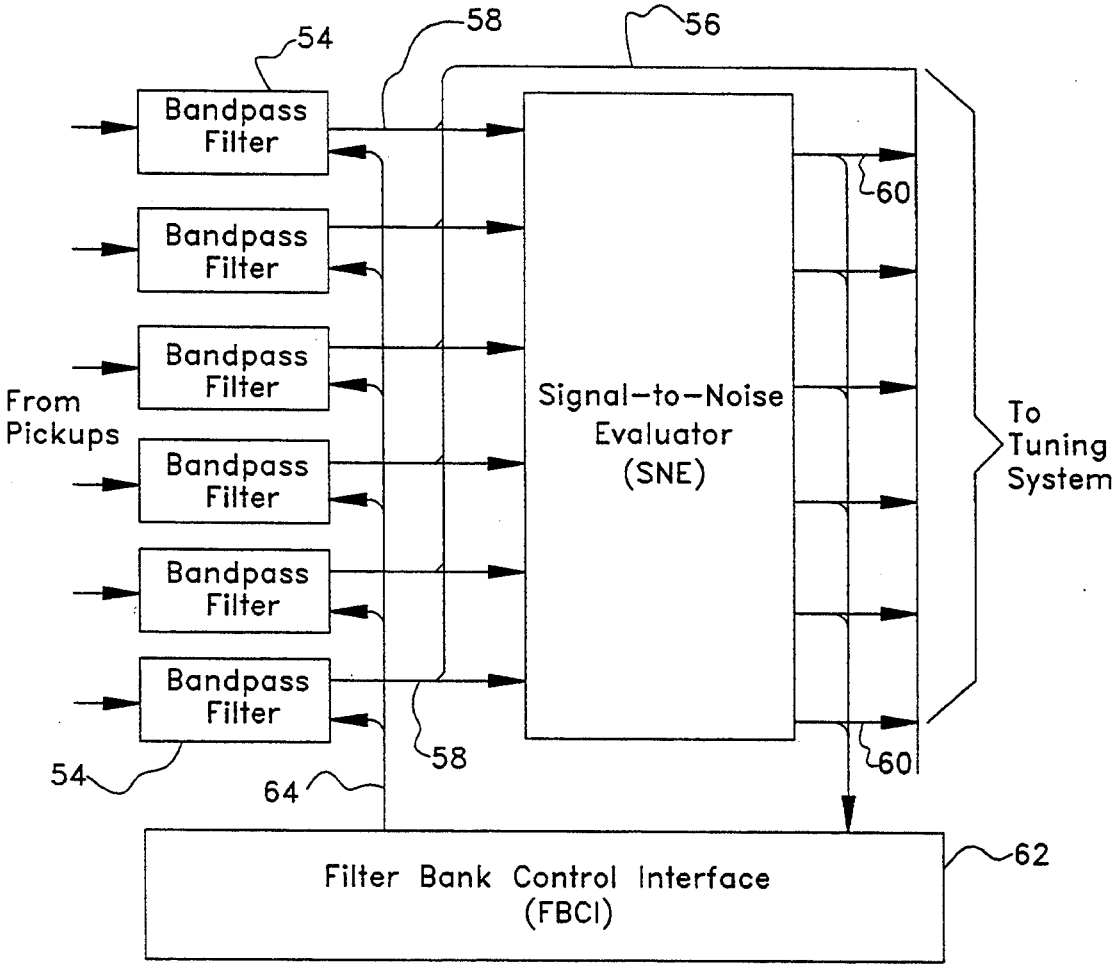
FIG. 4 depicts a preferred magnitude comparator system.

FIG. 4 depicts a functional block diagram of the magnitude comparator system (MCS) 14. Ideally, magnetic pickups only convert the vibrations of a specific string into electrical impulses while ignoring the vibrations of adjacent strings. In reality, despite the best design and manufacturing efforts to minimize cross talk, each pickup will detect the motion of adjacent strings and translate those motions into an electrical signal. FIG. 2 shows what the pickup of a single string could be (for illustrative purposes the output of this hypothetical pickup is shown as a pure tone). The frequency shown is 330 Hz, the pitch of the standard guitar's E string. FIG. 3 shows what happens to the output of the E string's pickup if it detects the motion of the A string as well as the motion of the E string. Again, the A string's frequency is represented by a pure tone for the sake of simplicity. The composite signal, shown in FIG. 3, with a lower amplitude signal from the A string superimposed on the higher amplitude signal from the E string, is difficult for the tuning system to interpret.

If a "standard" or "conventional" guitar tuning is planned, then the center frequency of the E string is 330 Hz, and the A string is 440 Hz. Also assume that the output level of each pickup is a nominal 1 V, adjacent string pickup is 6 db down in voltage magnitude, and that the sensitivity of the pitch detector is 16.4 Hz per volt. Since the information that the tuning system requires is contained in the frequency of the signal, not the amplitude, also assume an arbitrary amplitude threshold of 0.25 V will be ignored. Based upon these assumptions, crosstalk creates an operational problem. If the A string is plucked, it produces a 0.5 V (i.e., 6 db down from nominal) signal at the output of the E string's pickup. Since the threshold for the tuning system is arbitrarily set up at 0.25 V, the E string's tuning system will attempt to tune the E string, even though it is actually the A string that was sounded. Depending upon the scheme used to detect the frequency coming off of the pickup, crosstalk between adjacent strings can corrupt the signals as seen by the tuning system, and ultimately result in an improperly tuned instrument.

The MCS depicted in FIG. 4 eliminates the inter-string pitch confusion. The MCS includes one bandpass filter 54 for each of the pickups 10. The bandpass filters 54 feed a signal-to-noise evaluator (SNE) 56, shown in greater detail in FIG. 5, via a set of audio lines 58. The SNE 56 develops control signals to be sent to the tuning system 22 via control lines 60. These control signals also feed a filter bank control interface 62 which selects a specific bandpass filter 54 through control lines 64.

In operation, the output of each magnetic pickup 10 is sent through an independent bandpass filter 54. The center frequency of this filter, its associated "Q", and the slope of its filter skirts are determined to some extent by the output of the SNE 56. Initially, however, the center frequency, "Q", and skirt slopes are fixed and determined by the requirements of the desired tuning plan for the instrument as well as the characteristics of the tuning system. As with the previously example regarding the E and A strings, the slope of the filter will have to ensure that the amplitude of the A string's vibrations by the E string's pickup are reduced to below 0.25 V to avoid a tuning attempt by the E string's tuning system. In this example, this may be accomplished by a bandpass filter of order one. The center frequency of the A string is 1.33 octaves away from the E string's center frequency. Since the tuning threshold in this example is set to 0.25 V, and the nominal output of the A string (in the E string's pickup) is half what the nominal E string level would be, the E string's pickup output of 0.5 V (due to the A string's vibration) must be attenuated another 6 db through some other means to avoid improper triggering of the 0.25 V threshold. This calculation, 6 dB/1.33 octaves (approximately 4,51 db/octave), along with the knowledge that each filter order produces 6 dB/octave roll-off, tells us that a single order filter will give the desired ultimate amplitude of the cross-coupled A string. Using a first order filter guarantees, in this example, that plucking the A string will not induce tuning, as it would be an improper attempt at tuning, of the E string.

Figure 7:
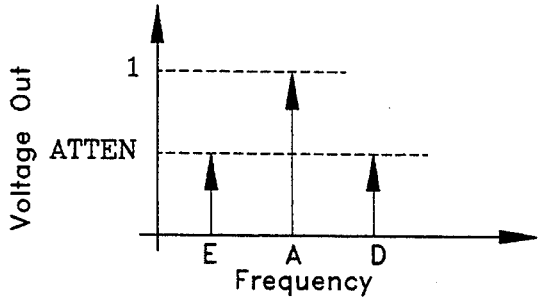
FIG. 7 depicts the effect of adjacent strings on a particular string of interest.

The output of the bandpass filter 54 is passed into the SNE 56. The SNE ventures a "first guess" at which string is being plucked for tuning. Assuming the 6 db adjacent string figure in the previous example, the SNE profile for the A string is that shown in FIG. 7. The amplitude labeled "ATTEN" is determined by both the fringe characteristics of the pickups, as well as the filter order and center frequency of the bandpass filter 54. A provision is made for the bandwidth of the filters 54 to be adjusted by the rest of the tuning system. This mechanism allows the filters 54 to be adjusted depending upon the desired tuning of the instrument. Parameters such as center frequency and Q are adjustable to allow some alternate tunings.

Figure 5:
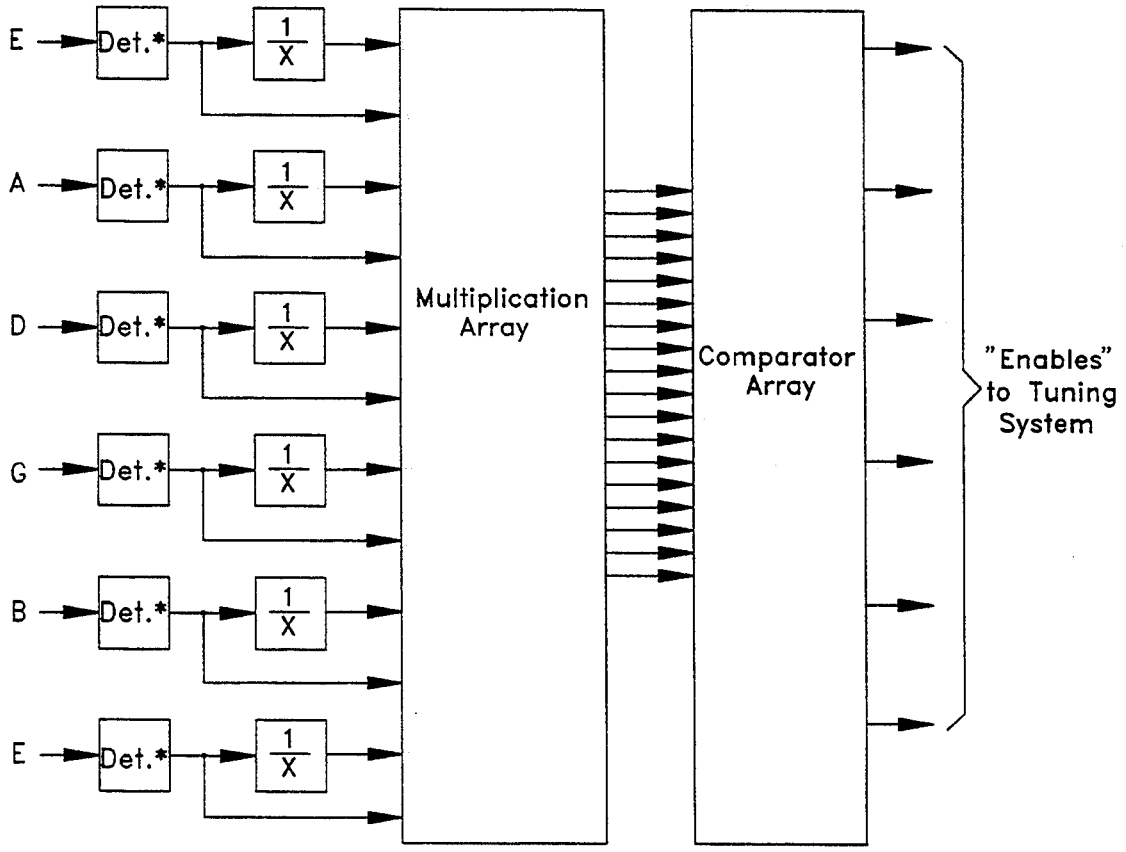
FIG. 5 depicts a general signal-to-noise evaluator.
Figure 6:
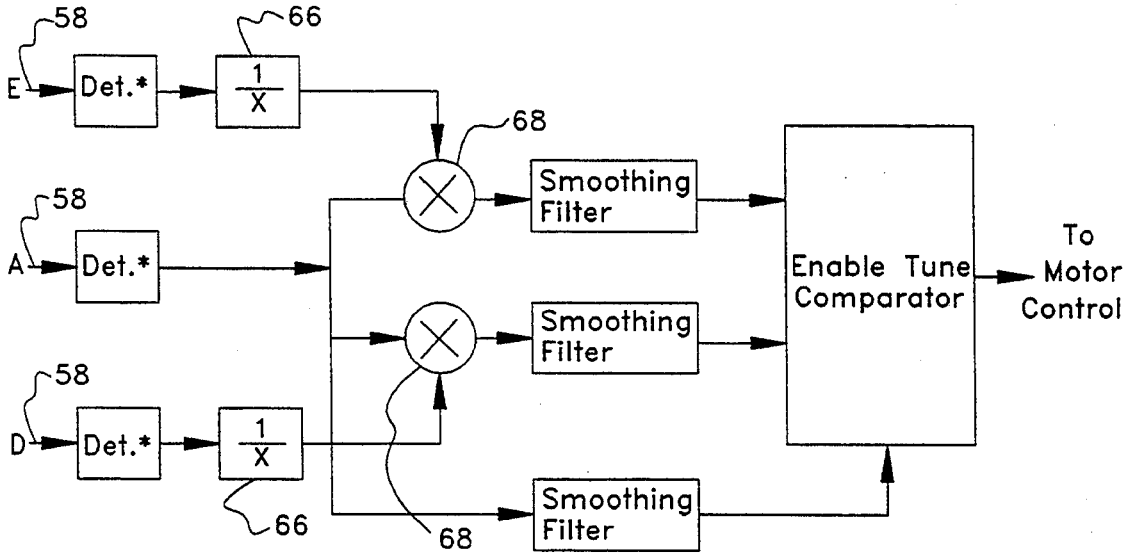
FIG. 6 is a block diagram of a signal-to-noise evaluator for a specific string of a musical instrument.

FIG. 5 depicts a schematic diagram of the signal to noise evaluator for a six stringed instrument. FIG. 6 provides greater detail of a signal-to-noise evaluator (SNE) 56 for one of the strings, in this case the A string, as an example. This circuit is repeated for the remainder of the strings of the fretted musical instrument. The SNE 56 operates by converting the amplitude output of three bandpass filters 54, the string of interest (referred to as "the main pickup") and the two adjacent strings (referred to as "auxiliary pickups") into a slowly varying DC voltage, or a digital equivalent. Thus, a ratio between the signal level present in the main pickup and the adjacent channels may be evaluated. The actual ratio is taken by dividing the main pickup output by the auxiliary pickup outputs. Functionally, this may be performed by multiplying the main pickup output by the reciprocal of the auxiliary pickup outputs. This is facilitated by reciprocal elements 66 and multipliers 68.

The two resultant quantities may then be evaluated according to a preset criterion. If a single string is plucked, then there will be a large difference, represented by a relatively large number, between the processed signal representing the string that was actually plucked and the signal processed after the auxiliary pickups. If the filter characteristics are sufficiently sharp, then the SNE will provide an excellent "preprocessing" block to single string tuning. If many strings are strummed all together, then the output of the SNE will provide little extra tuning information and the system must rely on additional information to perform the tuning function.

Figure 8:
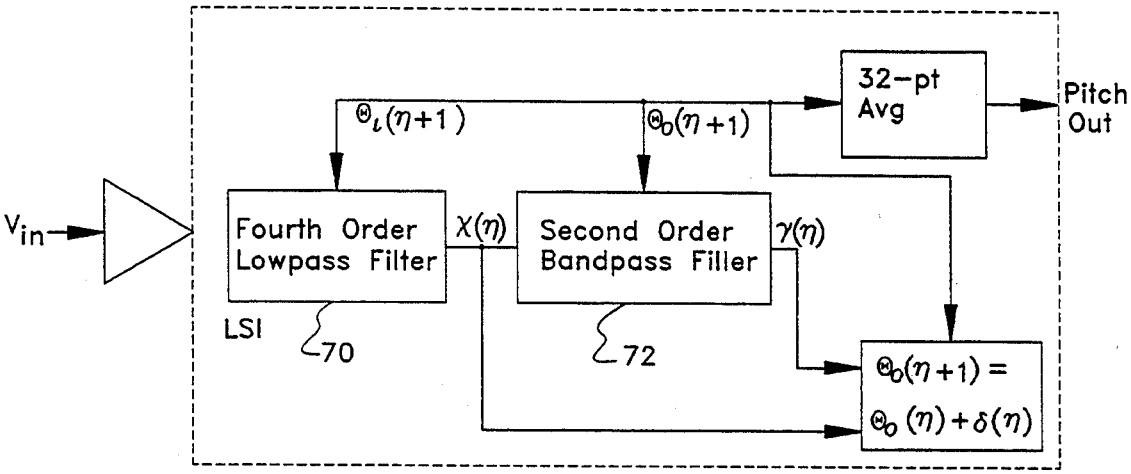
FIG. 8 depicts an infinite-impulse response filter pitch detector of the present invention.

FIG. 8 depicts a preferred pitch detector 69. This pitch detector is known as art infinite-impulse response (IIR) filter pitch detector, introduced in 1989 by John Lane of Motorola, Inc. An input signal is digitized and filtered by a lowpass filter 70 to reduce upper harmonics which would fool the convergence process. The output of the lowpass filter is then sent through a second order bandpass filter 72. The signal amplitude going into the bandpass filter is constantly compared (i.e., an error term is calculated) to the output of the bandpass filter. The center frequency of the filter is modified in such a way as to reduce the error between the input and output of the bandpass filter to a sufficiently small magnitude. The practical result of this pitch detection approach provides convergence to within a few cents (a cent is $2^{1/1200}$ of an octave) in less than 75 msec.

The present invention also provides means of preventing a form of confusion between strings. In the present invention, frets and strings of the instrument comprise an electrical switch element, as shown in FIG. 9. By depressing the string so that it comes into contact with the frets, a circuit is completed. Each of the strings of the musical instrument is "pulled high" through a large value pull-up resistor 74. This resistor should be in the megohm region to reduce risk of electrical shock to the musician, in case of malfunction. The frets may be at ground potential, for example. By shorting the string to a fret, the logic high previously present at the string, is reduced to a low logic level. The string may then be monitored by an appropriate logic interface, sensing either the string's low or high logic level, to enable or disable tuning of the string.

The motor control assembly 50 depends on the specific motor type selected to implement the present invention. The primary feature of the motor control assembly is the ability to sense the signals from the manual/automatic switch assembly 28 and the AND gate 44 and provide power to motors to provide the proper tension to the strings of the musical instrument.

Figure 10:
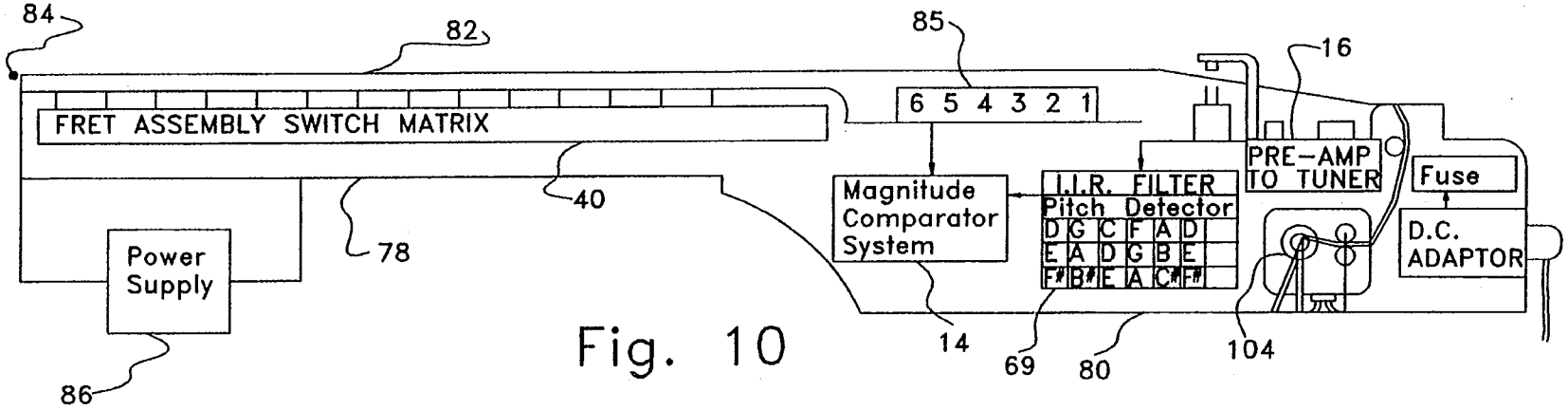
FIG. 10 is a side view of a stringed instrument incorporating the automatic tuning feature of the present invention.

FIG. 10 provides a side view of certain mechanical aspects of a fretted musical instrument employing the present invention, in this example an electric guitar. The guitar includes a body 76 that comprises a neck 78 and a trunk 80. The instrument also includes a plurality of strings 82. Normally, on a guitar, a string includes a nut or "bullet" 84 which acts as a stop on the bridge of the guitar on the trunk. In the present invention, however, the string is strung in the opposite direction with the nut or bullet on the string providing an anchor on the neck of the guitar. The trunk 80 also provides an access (not shown) to allow the musician inside in the event that a string breaks in the tuning assembly.

The nut also functions as an integral part of the fret assembly switch matrix, as previously described with regard to FIG. 9. Depressing a string against a fret disables the automatic tuning feature of the present invention and this feature is powered through a power supply 86 which may be provided by any conventional means, such as by rectifying conventional 115 V AC power or through a battery, as desired.

A control panel 85 provides for alternative tuning arrangements as shown in greater detail in FIG. 19.

Figure 11:
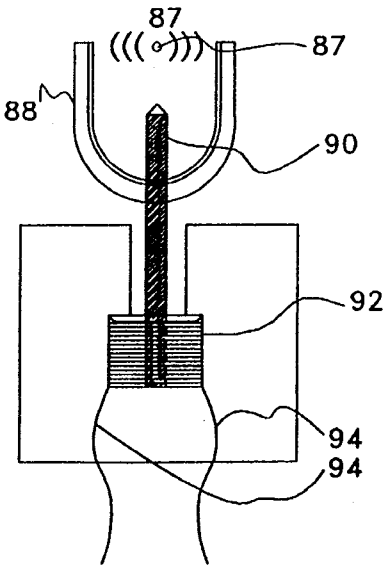
FIG. 11 depicts a baffled pickup that reduces cross-talk from adjacent strings of a musical instrument.

Each string 87 of the instrument is inserted through its own insulated baffle 88, as shown in FIG. 11. This arrangement minimizes field variance and reduces some effects of cross talk. A motion detector 90 senses the vibration of the string 87 and this sensing causes the detector 90 itself to vibrate. The motion detector 90 is preferably a magnetic material. The vibrating motion of the detector 90 creates motion of the detector within a coil 92. This generates an electromotive force (EMF) thus developing current in detector leads 94 which are coupled to the tuner circuitry of the present invention by way of an internal proamp. The tuning system pickups should be located adjacent to or as close to the bridge as possible since this is where convergence to a fundamental tone during string vibration occurs the quickest.

Figure 12:
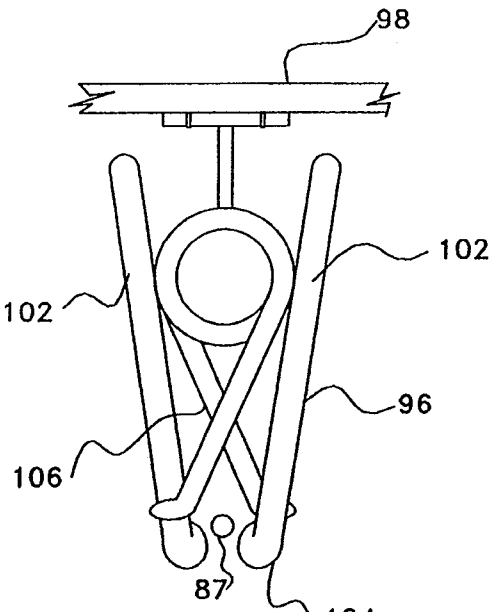
FIG. 12 depicts a spring clamp fastener that secures a string of a musical instrument.
Figure 13:
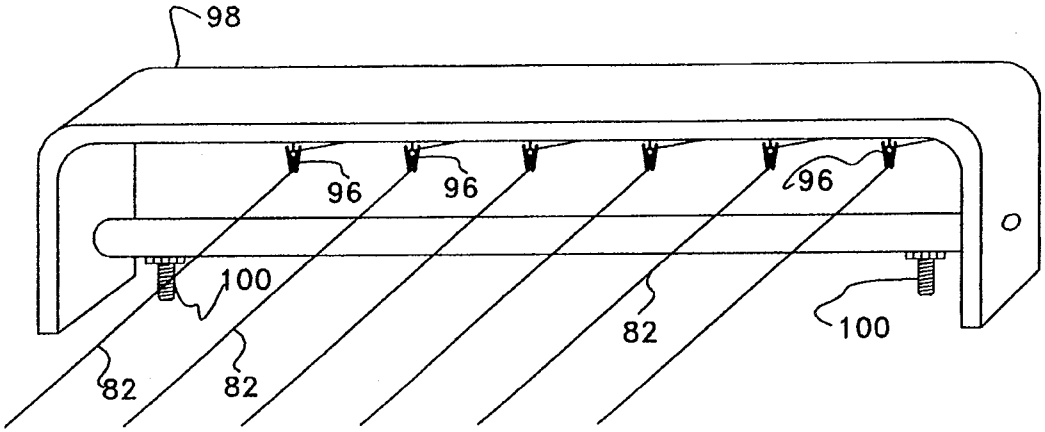
FIG. 13 depicts a plurality of the spring clamp fasteners of FIG. 12 as arranged on the musical instrument.

FIG. 12 depicts a spring clamp 96 that may be used with the present invention and FIG. 13 shows how the spring clamps 96 are deployed to securely hold a plurality of strings 82. The spring clamps 96 may be mounted to the underside of a hood 98 which may be mounted to the instrument body 80 by mounting bolts 100 or any appropriate means. The spring clamp 96 includes a pair of release arms 102, held together at their lower ends 104 by a spring mechanism 105. The lower ends 104 of the release arms secure a string 87 until the release arms are squeezed together thereby releasing the string. The spring clamp 96 retains a string as a motor winds a string toward its desired tuning. In operation, the spring clamp serves several functions: it hold the string taut while the "loose" end is fed into the appropriate guidereel canal; it keeps the string from making fret contact during loading (which disables the associated stepper motor); it frees the musician from having to hold the string until it is wound, and it produces the first strummed tone from the string when string tension pulls the string out of the clamp.

Figure 14:
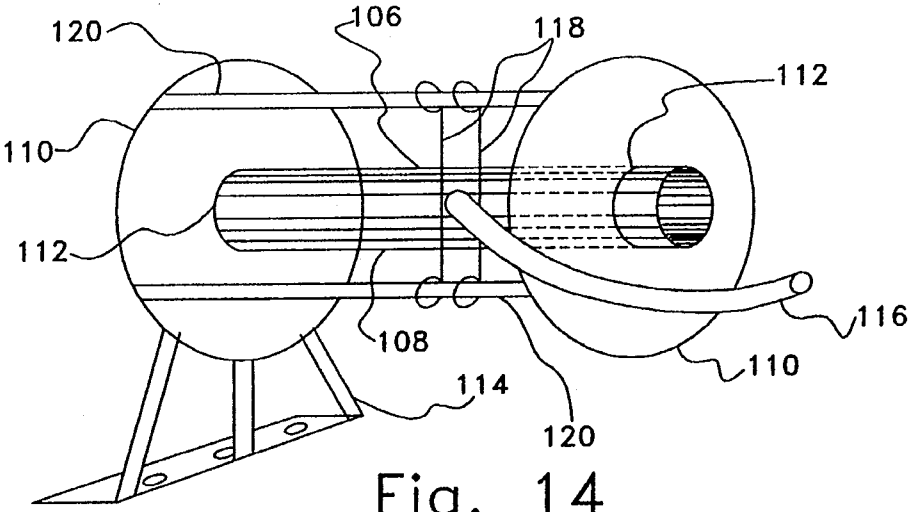
FIG. 14 depicts one of a number of guide reel spools that mechanically secure the strings of the instrument.

FIG. 14 depicts one of a plurality of guidereel winding spools 104. The preferred location of the guidereel winding spools or assemblies is shown in FIG. 10. The guidereel winding assembly comprises a winding core 106 which may be a plurality of horizontal spokes 108. Spokes 108 were selected because as the winding core rotates upon initial installation of a string, the spokes grasp the string thereby simplifying this installation. The winding core 106 is mounted to a stepping motor gear train power axle by way of a fitted gear sleeve 109. The winding core penetrates spool ends 110 through holes 112. As a stepper motor turns, the spool ends 110 remain stationary to retain the string on the spool. The spool ends are securely mounted to the instrument body by mounting brackets 114.

The guidereel assembly also includes a flexible conduit 116 through which a string is inserted. The conduit 116 guides the string onto the winding spool core 106. The conduit 116 is mounted to a pair of vertical pegs 118 which are slidably mounted to a pair of horizontal runners 120 which may conveniently be mounted of the spool ends 110. As the string feeds onto the winding core 106, the vertical pegs slide back and forth on the runners, guiding the conduit 116 to lay down neat, even layers of wound string.

Figure 16:
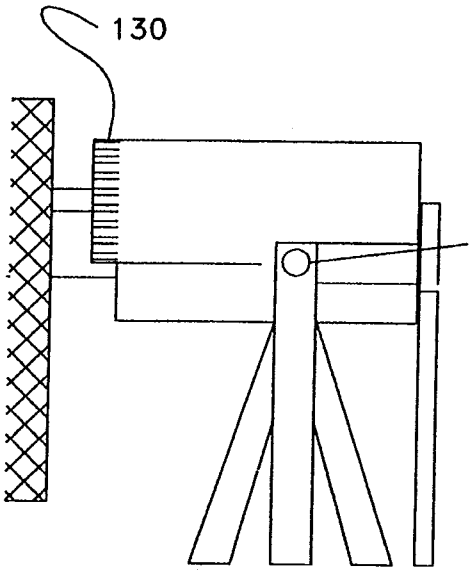
FIGS. 15 and 16 depict the mounting of a guide reel spool to a stepper motor.
Figure 15:
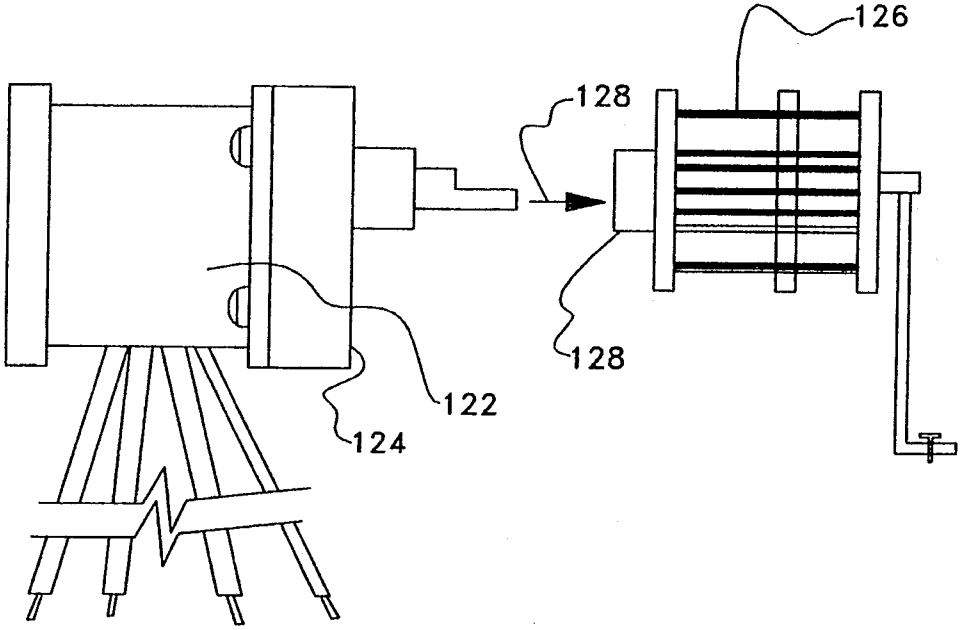

FIGS. 15 and 16 show how the guidereel assembly of FIG. 14 preferably mounts to a stepper motor. A stepper motor 122 is coupled to a gear train 124. The stepper motor is preferably a permanent magnet stepper motor, such as model PBS, part #3208-003. The stepper motor chosen should have no less than 1065 steps per revolution to provide adequate tuning resolution. The reduction ratio of the gear train 124 is carefully selected to provide the proper torque and turning speed for preselected tuning characteristics adapted to the selected stepper motor. The gear reduction is the preferred embodiment is 75, with a step angle of 0.2 and 1,800 steps per revolution. For a pulse train to the motor of 200 Hz, this arrangement provides 6.67 rpm. The preferred embodiment provides typically 136 oz-in. of torque with an input power of about 8.5 watts and winding resistance of 32 Ω. Each motor weighs approximately 18 ounces.

The stepper motor, from its final gear in the gear train, couples to a guidereel assembly 126 as shown by arrow 128. The coupling where the stepper motor/gear train 122/124 couple to the guidereel assembly 126 also includes an external gear 130 which provides motive force for a set of pinch rollers 132 (see FIG. 17). This external gear is preferably about a ⅛" diameter spur gear and drives a reciprocal gear 134 (FIG. 17) for proper coupling. The pinch rollers 132 provide positive and sure grasping of the string.

Figure 17:
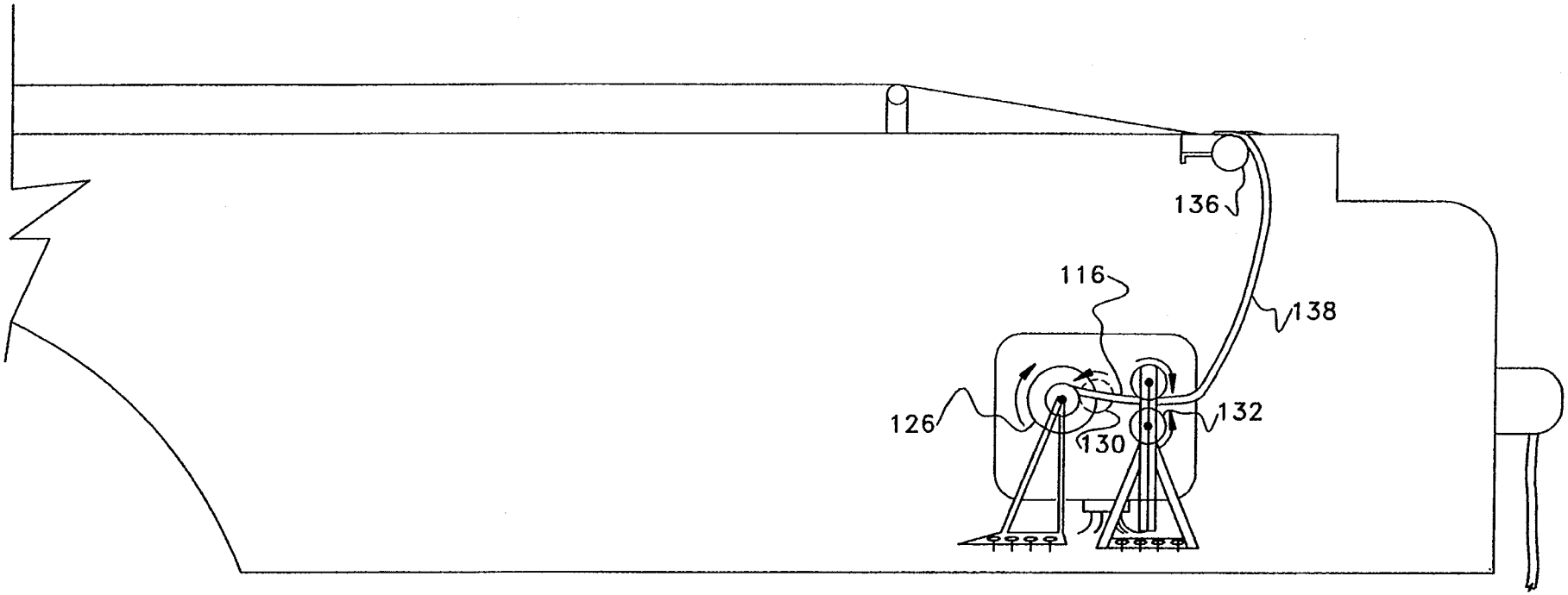
FIG. 17 depicts a side view of a preferred apparatus for automatically guiding a string into the tuning device of the present invention.

FIG. 17 depicts a side view relationship between the various movable members of the present invention which cooperate to tune a string of a musical instrument. A reciprocal gear 132 (shown in phantom) drives an external gear on the guidereel assembly 126 and a mating gear on the upper of the pinch rollers 132. The lower of the pinch rollers is preferably friction driven from the upper pinch roller but may also be gear driven. The directional arrows of Figure depict the direction of rotation of the various rollers as a string is made more taut.

FIG. 17 also depicts another important feature of the present invention. From the spring clamps 96 (not shown in FIG. 17 for simplicity), a string is placed on a cylinder 136 to guide the string into a guidereel canal 138. The cylinder 136 may be a stationary drum to improve the torque holding the string or it may be a pulley mechanism to reduce friction and thus load on the stepper motor. The guidereel canal 138 significantly simplifies installing a new string. The musician simply inserts the string over the cylinder 136 and continues to feed the string into the guidereel canal 138. The guidereel canal directs the string between the pinch rollers 132 which feed the string automatically into the flexible conduit 116. The flexible conduit 116 then automatically feeds the string into the guidereel assembly as previously described with regard to FIG. 14.

FIGS. 18 A, B, and C depict the tuner bypass and manual motor manipulation feature of the present invention. A set of toggles switches 140 provide manual control of stepper motor operation for initial tuning of a new string or when desired. The middle or upright position of the toggle switch (its "home" position by spring action) is its normal position for automatic tuning operation. Depressing the toggle in manual operation to the left (toward the "flat" musical symbol) unwinds a string (causing the string to go "flatter", i.e. lower in frequency) and depressing the toggle to the right (toward the "sharp" symbol) winds the string (i.e., "sharper").

A master volume control 142 activates the tuning circuitry for full automatic operation for all of the strings. In addition, each string is provided with an individual volume control potentiometer 144 to enable automatic adjustment of the frequency of an individual string.

FIG. 19 depicts the control panel 85 that provides alternative tuning arrangements for automatic operation. The control panel includes a plurality of operator programmable tunings by means of a plurality of pitch selection buttons 146, arranged in rows and columns, one column for each string. Element 148 arbitrarily denotes the row to select for standard tuning. The control panel 85 provides a signal to the magnitude comparator system 14 (see FIG. 1) to provide tuning arrangements that differ from "standard" or can be used to replace various mechanical devices that simultaneously tune all the strings the same number of steps or half-steps.

In operation, each string in rum is inserted at the neck of the instrument and directed through its appropriate spring clamp. After taking the slack out the string, the musician inserts the string into the proper hole to direct the string into the guidereel canal for that string. Next, the operator turns the master volume control for the system up and verifies that the control panel 85 is set for standard pitch settings. The toggle switch for manual motor control is switched to forward. Once the string in the guidereel canal reaches the pinch rollers, the rollers pull the string through into the flexible conduit that guides the string to the core of the guidereel assembly. As the winding core turns, gaps between the spokes catch the string, crimp it, and wind it. When the string becomes sufficiently taut, the string pulls out of the spring clamp which action plucks the string to provide an initial tone. During this operation, the string must be clear of the frets because if a string touches a fret, the stepper motor for that string is disabled.

Once manual operation has tuned the string to a predetermined melodic inter below standard pitch, the system automatically switches to automatic operation. Up until this time, the system winds the string in "fast forward" until the string is very nearly in tune. The stepper motor for each string will remain in forward mode (at a slower "fine tune"speed) until standard pitch for that string is reached. The automatic tuning system also detects when a string gets out of tune by an integral fraction of the predetermined melodic interval previously mentioned and automatically tunes the string. This may be referred to as pitch specific actuation.

If over-winding occurs, the system recognizes any pitch up to a whole tone sharp of standard pitch for each string. If the player uses the tremolo bar, or any other pitch altering device, volume for the system should be turned completely down.

To remove strings, the system is also bypassed by turning the master volume down and using the manual motor toggle switch in the "flat" direction.

Many modifications and variations may be made in the embodiments described herein and depicted in the accompanying drawings without departing from the concept and spirit of the present invention. Accordingly, it is clearly understood that the embodiments described and illustrated herein are illustrative only and are not intended as a limitation upon the scope of the present invention. For example, the system may incorporate frequency indication in the form of digital readout of string pitch. Also, although the present embodiment has been described as employing one stepper motor per string, those of skill in the art will recognize that a single stepper can be used and electro-mechanically coupled to the selected guidereel assembly. This provides the advantage of great weight savings but introduces additional mechanical complexity and thus the potential for breakdown of the system.

I claim:

1. A stringed musical instrument comprising:

a. an instrument body, the body comprising a trunk and a neck;

b. a plurality of tensioned strings removably attached to the body;

c. a plurality of tuning system pickups, one of said plurality of pickups corresponding to one of said strings, each mounted to the body adjacent to said one of the strings;

d. frets on the neck for manually altering the pitch of the strings;

e. a plurality of guidereel assemblies coupled to the body and one of said plurality of guidereel assemblies associated with a respective one of said strings to provide mechanical coupling and tensioning of each of said strings;

f. a motor coupled to the body and to one of the guidereel assemblies g. means electrically coupled to the motor for automatically and continuously tuning the instrument comprising i. a magnitude comparator to receive frequency signals from the pickups indicative of the frequency of vibration of selected ones of said strings and to distinguish the frequency of vibration of one of the selected ones of said strings from the frequency of another one of said selected ones which is adjacent to said one and to develop and output a tuning signal when a string of said selected ones of said strings requires tuning;

ii. an audio tuning system to receive the tuning signal from the magnitude comparator and develop a motor control signal at an output;

iii. a manual/automatic switch assembly to receive the motor control signal from the output of the audio tuning system and to provide a motor actuation signal at an output; and iv. a motor control circuit assembly to receive the actuation signal from the output of the manual-/automatic switch assembly and to energize the motor to tune said string of said selected ones; and h. a switch means coupled to the motor control circuit assembly to disable the motor control circuit assembly when said string is in contact with one of said frets.

2. The stringed musical instrument of claim 1 further comprising a guide reel canal adjacent each of said plurality of guidereel assemblies to guide said respective one of said strings into the guidereel assembly associated with the respective one of said strings.

3. The stringed musical instrument of claim 1 wherein each of said plurality of guidereel assemblies includes a winding core comprising a plurality of spokes and a flexible conduit to guide said respective one of said strings into said winding core.

4. The strings musical instrument of claim 1 further comprising an insulated baffle adjacent each of said pickups.

5. The stringed musical instrument of claim 1 further comprising a bridge on the trunk for supporting the strings and wherein the tuning system pickups are located adjacent the bridge.

6. The stringed musical instrument of claim 1 wherein the motor is a stepper motor:

a. wherein said stepper motor has a reduction gear output of no less than 1065 pulse signals per output shaft revolution; and b. whereby the pulse rate of the pulse signals determines the rate of musical pitch adjustment.

7. The stringed musical instrument of claim 1 wherein the means for automatically tuning further includes a volume control potentiometer coupled to the switch assembly for disabling the automatic tuning of the instrument.

8. The stringed musical instrument of claim 1 wherein said switch means comprises a fret assembly switch matrix comprising a plurality of switches, each of the switches being actuated by contact between one of said strings and one of said frets to provide an input to the motor control circuit assembly to disable automatic tuning of said string when said string contacts one of said frets.

9. The stringed musical instrument of claim 8 wherein the fret assembly switch matrix develops logic signals for system control.

10. The stringed musical instrument of claim 1 further comprising a control panel coupled to the magnitude comparator to permit selectable non-standard tuning of the instrument.

11. The stringed musical instrument of claim 1 further comprising a spring clamp fastener on the trunk of the instrument for each of said plurality of strings to retain the strings of the instrument while installing new strings.

12. The stringed musical instrument in claim 1 wherein the instrument is a guitar.

13. An automatic tuning system for a fretted string instrument comprising a. a plurality of pickup means, each of said pickup means for receiving an audible tone from one of a plurality of vibrating strings and for distinguishing tones from adjacent ones of said strings during simultaneous vibration of more than one of said strings to develop a pitch specific actuation signal;

b. a control circuit means for receiving the pitch specific actuation signal and developing a control signal to tune the instrument;

c. string tensioning means for receiving the control signal from the control circuit and vary the tension on one of said strings in response; and d. a switch means coupled to the string tensioning means for disabling the string tensioning means for said one of said strings when said one of said strings is in contact with a fret.

14. The automatic tuning system of claim 13 wherein the means for distinguishing comprises a magnitude comparator for receiving a signal from said plurality of pickup means and includes a signal to noise evaluator for filtering signals from unwanted tones.

15. The automatic tuning system of claim 13 wherein the means for distinguishing comprises a. a plurality of bandpass filters, one of said plurality of bandpass filters for each of said pickup means;

b. a signal-to-noise evaluator coupled to the bandpass filters to develop control signals; and c. a filter bank control interface coupled to the signal-to-noise evaluator to receive the control signals and to select one of said bandpass filters in response to the control signals.

16. A method of automatically tuning a string of a musical instrument comprising the steps of a. vibrating the string;

b. detecting the tone created by the vibration of the string to develop a detection signal indicative of the tone of the vibrating string;

c. turning a stepper motor coupled to the string to vary the tone of the string at a first speed until the string is vibrating at a predetermined frequency that is a melodic interval from a predetermined reference frequency;

d. turning the stepper motor at a second, slower speed until the string is vibrating substantially at the predetermined reference frequency; and e. disabling the automatic tuning of the string when the string contacts a fret.

17. The method of claim 16 further comprising the step of retuning the string when the frequency of vibration of the string is flat or sharp by a predetermined melodic interval from the predetermined reference frequency.

* * * * *